US010052536B1

(12) United States Patent
Janus, Sr. et al.

(10) Patent No.: US 10,052,536 B1
(45) Date of Patent: Aug. 21, 2018

(54) FREESTANDING GOLF PUTTER WITH ROUNDED CLUBFACE

(71) Applicants: David Michael Janus, Sr., Harvey's Lake, PA (US); David Michael Janus, Jr., Harvey's Lake, PA (US); Theresa Ann Janus, Harvey's Lake, PA (US)

(72) Inventors: David Michael Janus, Sr., Harvey's Lake, PA (US); David Michael Janus, Jr., Harvey's Lake, PA (US); Theresa Ann Janus, Harvey's Lake, PA (US)

( * ) Notice: Subject to any disclaimer, the term of this patent is extended or adjusted under 35 U.S.C. 154(b) by 0 days.

(21) Appl. No.: 15/699,245

(22) Filed: Sep. 8, 2017

(51) Int. Cl.
*A63B 53/04* (2015.01)
*A63B 53/00* (2015.01)
*A63B 53/06* (2015.01)

(52) U.S. Cl.
CPC ..... *A63B 53/0487* (2013.01); *A63B 53/007* (2013.01); *A63B 53/065* (2013.01); *A63B 2053/0408* (2013.01); *A63B 2053/0441* (2013.01); *A63B 2053/0491* (2013.01); *A63B 2209/00* (2013.01)

(58) Field of Classification Search
CPC . A63B 53/065; A63B 53/007; A63B 53/0487; A63B 2053/0408; A63B 2053/0441; A63B 2053/0491
USPC ..... 273/340, 341, 342, 345, 350
See application file for complete search history.

(56) References Cited

U.S. PATENT DOCUMENTS 4,508,342 A * 4/1985 Drake ..... A63B 53/0487 473/204
4,964,639 A 10/1990 Tucker
5,213,332 A * 5/1993 Fahy ..... A63B 69/3685 473/243
5,362,056 A * 11/1994 Minotti ..... A63B 53/0487 473/251
5,447,310 A 9/1995 Jernigan
5,470,070 A 11/1995 Bendo
6,179,727 B1 * 1/2001 Giordano ..... A63B 53/0487 473/330
6,524,193 B1 * 2/2003 Devore ..... A63B 53/0487 473/251
6,634,956 B1 10/2003 Pegg
6,958,019 B2 10/2005 Rohrer
7,473,185 B2 1/2009 Anderson et al.
2003/0157993 A1 * 8/2003 Pechter ..... A63B 53/007 473/340

(Continued)

OTHER PUBLICATIONS

Van Sickle, Gary, "Radius Roll putter: the latest, greatest rounded-face putter incarnation," Golf.com, Jan. 24, 2014, http://www.golf.com/equipment/radius-roll-putter-latest-greatest-rounded-face-putter-incarnation.

*Primary Examiner* — Benjamin Layno
(74) *Attorney, Agent, or Firm* — Brian Chew

(57) ABSTRACT

A freestanding putter with a T-shaped head and rounded clubface is disclosed. The rounded clubface prevents a ball from bouncing or skidding when struck by the putter. The freestanding nature of the putter enables a golfer to repeatedly step away from the putter for a view of the ball to the cup and return to the putter to adjust the direction in which the putter is aiming. Once the golfer is ready to attempt a putt, he or she can address the putter and ball without losing the previously established aim of the putter. Accordingly, the putter enables the golfer to aim and subsequently strike a golf ball with greater accuracy and consistency.

15 Claims, 7 Drawing Sheets

(56) References Cited

U.S. PATENT DOCUMENTS

| | | | | |
|---|---|---|---|---|
| 2005/0003902 | A1* | 1/2005 | Reese | A63B 53/0487<br>473/340 |
| 2005/0107185 | A1* | 5/2005 | Lu | A63B 53/0487<br>473/340 |

* cited by examiner

FREESTANDING GOLF PUTTER WITH ROUNDED CLUBFACE

BACKGROUND

1. Technical Field

The present disclosure relates generally to a golf club. More particularly, the present disclosure relates to a freestanding golf putter having a rounded clubface.

2. Description of Related Art

In the game of golf, about half of all strokes are expected to be played on the putting green using a putter. Typically, great care is taken to properly aim before attempting a putt in order to reduce the total number of strokes in a game. For example, a golfer may stand behind his or her golf ball to determine an appropriate target or trajectory in order to successfully strike the ball into the hole based on the position of the ball and the topography of the green. However, when the golfer returns to the ball to attempt the putt, he or she must yet again take aim based on a different viewing angle than from directly behind the ball. As a result, the clubface of the putter might not be properly aimed toward the intended target, leading to missed putts. Furthermore, even if the clubface is properly aimed, conventional putter designs using a flat club may cause a golf ball to skid or bounce when struck and deviate from the intended target or trajectory. This in turn may lead to additional strokes and/or frustration for the golfer.

Based on the foregoing, there is a need in the art for a golf putter that enables a golfer to aim and subsequently strike a golf ball with greater accuracy and consistency.

The above problems in the related art are considered as matters that have been addressed by the inventor to derive the present inventive concept, or as matters discovered during the course of deriving the present inventive concept. Thus, the problems may not be simply referred to as information that was known to the general public prior to filing the present disclosure.

SUMMARY OF EMBODIMENTS

Various embodiments of the present disclosure include a freestanding golf putter. In some embodiments, the T-shaped putter head includes: a front body portion including a first hollow cylindrical tube comprising a first end, a second end, and an axis that extends in a first direction through a center of the first end and a center of the second end; and a rear body portion comprising a third end, a fourth end, and an axis that extends in a second direction through a center of the third end and a center of the fourth end; wherein the first direction is perpendicular to the second direction, wherein the third end of the rear body portion is attached to the front body portion at a point that bisects length of the front body portion from the first end to the second end in the first direction, wherein length of the rear body portion in the second direction is greater than width of the rear body portion in the first direction, and wherein a rounded surface along the length of the front body portion from the first end to the second end in the first direction forms a striking face for contacting a golf ball; and a shaft attached to the putter head.

In an exemplary embodiment, the putter head further includes: a first weight attached to the first end of the front body portion; a second weight attached to the second end of the front body portion; and a third weight attached to the fourth end of the rear body portion.

In another exemplary embodiment, thickness of each of the first weight, the second weight, and the third weight is 0.125 inches to 0.5 inches.

In another exemplary embodiment, length of the putter head in the first direction is 6.5 inches to 7 inches; and width of the putter head in the second direction is 4.25 inches to 5.25 inches.

In another exemplary embodiment, outer diameter of the front body portion is 1.5 inches.

In another exemplary embodiment, the front body portion includes a wall having thickness of 0.0625 inches forming the first hollow cylindrical tube.

In another exemplary embodiment, the rear body portion further includes one of a second hollow cylindrical tube and a hollow rectangular tube.

In another exemplary embodiment, the rear body portion further includes at least one wall having thickness of 0.0625 inches forming the one of the second hollow cylindrical tube and the hollow rectangular tube.

In another exemplary embodiment, the rear body portion comprises a solid cuboid member.

In another exemplary embodiment, width of the rear body portion in the first direction is 1 inch to 1.75 inches; and height of the rear body portion in a third direction orthogonal to the first direction and the second direction is 0.125 inches to 1.5 inches.

In another exemplary embodiment, length of the rear body portion from the third end to the fourth end in the second direction is 3.25 to 3.75.

In another exemplary embodiment, the putter head further includes at least one alignment line formed on an upper surface of the rear body portion and parallel to the second direction.

In another exemplary embodiment, the putter head further includes at least one alignment line formed on an upper surface of the rear body portion and parallel to the first direction.

In another exemplary embodiment, the putter further includes a stem attached to the rear body portion and extending in a third direction orthogonal to the first direction and the second direction, wherein the shaft is attached to the stem.

In another exemplary embodiment, the front body portion and the rear body portion are formed of steel or stainless steel.

The foregoing, and other features and advantages, will be apparent from the following, more particular description of the exemplary and preferred embodiments, the accompanying drawings, and the claims.

BRIEF DESCRIPTION OF THE DRAWINGS

The present disclosure will become more fully understood from the specification and the accompanying drawings, wherein.

DETAILED DESCRIPTION OF EMBODIMENTS

Figure 1:
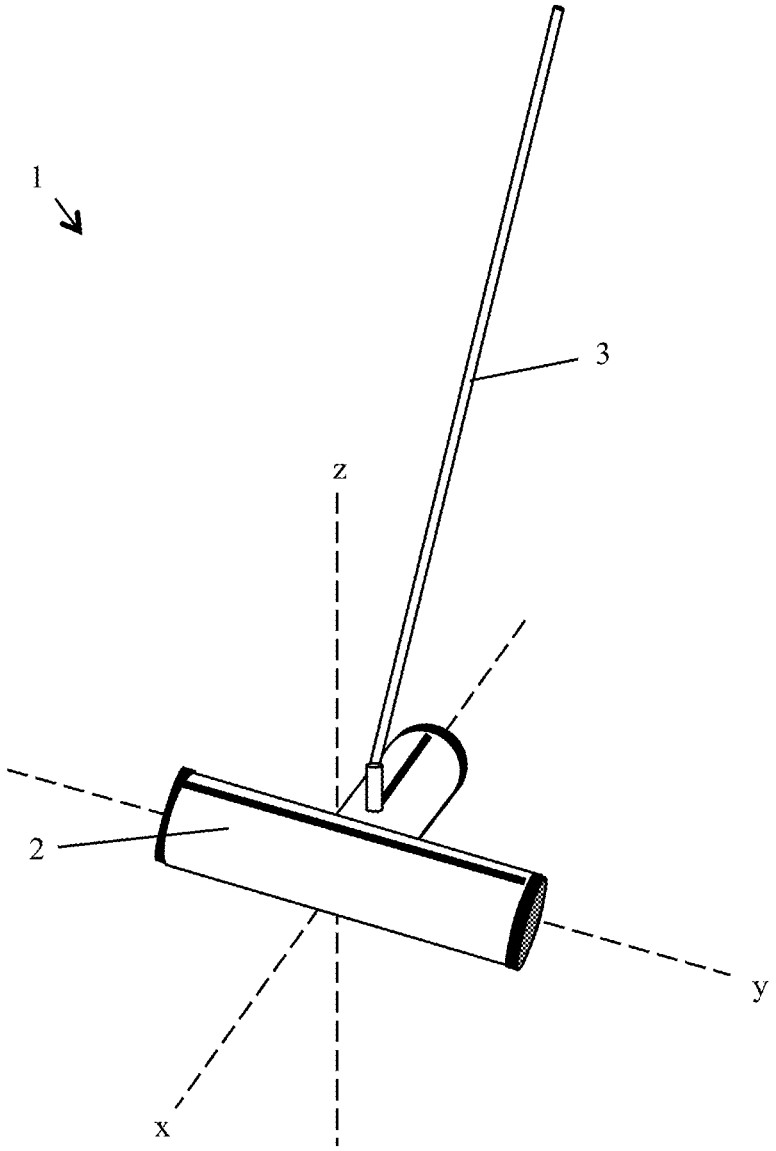
FIG. 1 is a front, top, and left side perspective view of an example configuration according to various embodiments.

The following description is merely exemplary in nature and is in no way intended to limit the various embodiments, their application, or uses. It should be understood that the terminology used herein is used for the purpose of describing particular embodiments only, and is not intended to limit the scope of the present disclosure. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may. Features that are described in the context of separate embodiments may also be provided in combination in a single embodiment. Conversely, various features that are, for brevity, described in the context of a single embodiment, may also be provided separately or in any suitable subcombination. New claims may be formulated to such features and/or combinations of such features during the prosecution of the present application or of any further application derived therefrom.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the various embodiments of the present disclosure. Structures described herein are to be understood also to refer to functional equivalents of such structures.

It should be understood that steps within a method may be executed in different order without altering the principles of the present disclosure. Additionally, the components and/or elements recited in any apparatus or system claim may be assembled or otherwise operationally configured in a variety of permutations and are accordingly not limited to the specific configuration recited in the claims.

As will be understood by one skilled in the art, all ranges recited herein also encompass any and all possible sub-ranges and combinations of sub-ranges thereof, as well as the individual values making up the range, particularly integer values. Any listed range can be easily recognized as sufficiently describing and enabling the same range being broken down into at least equal halves, thirds, quarters, fifths, or tenths. A recited range (e.g., weight percent, absolute weight) includes each specific value, integer, decimal, or identity within the range. As will also be understood by one skilled in the art, all language such as "up to," "at least," greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specified values recited for radicals, substituents, and ranges, are for illustration only; they do not exclude other defined values or other values within defined ranges for radicals and substituents.

The drawings described herein are for illustrative purposes only of selected embodiments and not all possible implementations, and are not intended to limit the scope of any of the various embodiments disclosed herein or any equivalents thereof. It is understood that the drawings are not drawn to scale. For purposes of clarity, the same reference numbers will be used in the drawings to identify similar elements.

Exemplary embodiments will now be described in detail with reference to the accompanying drawings.

FIG. 1 is a perspective view of a golf putter 1 according to various embodiments.

Referring to FIG. 1, a golf putter 1 comprises a T-shaped putter head 2 and a shaft 3 attached to the putter head 2.

Figure 2:
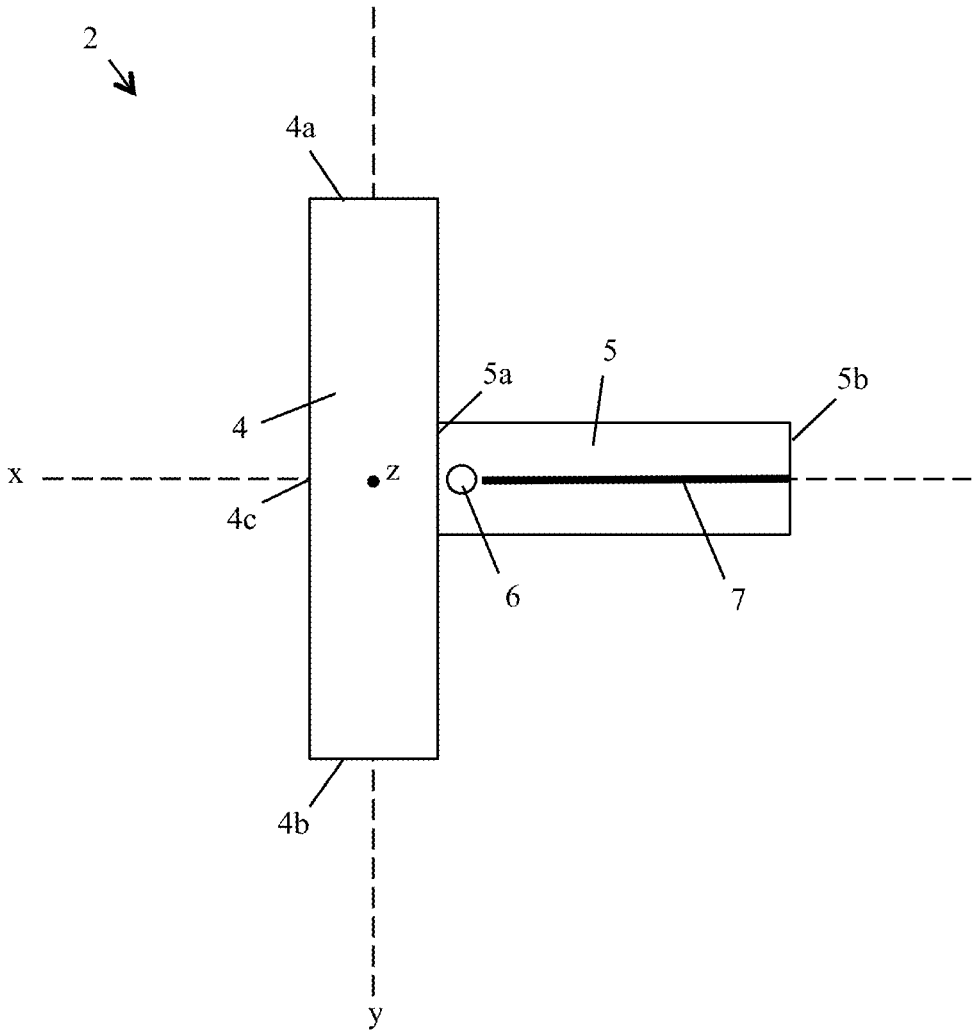
FIG. 2 is a plan view of an example configuration according to various embodiments.

FIG. 2 is a plan view of the putter head 2 according to various embodiments.

Figure 3:
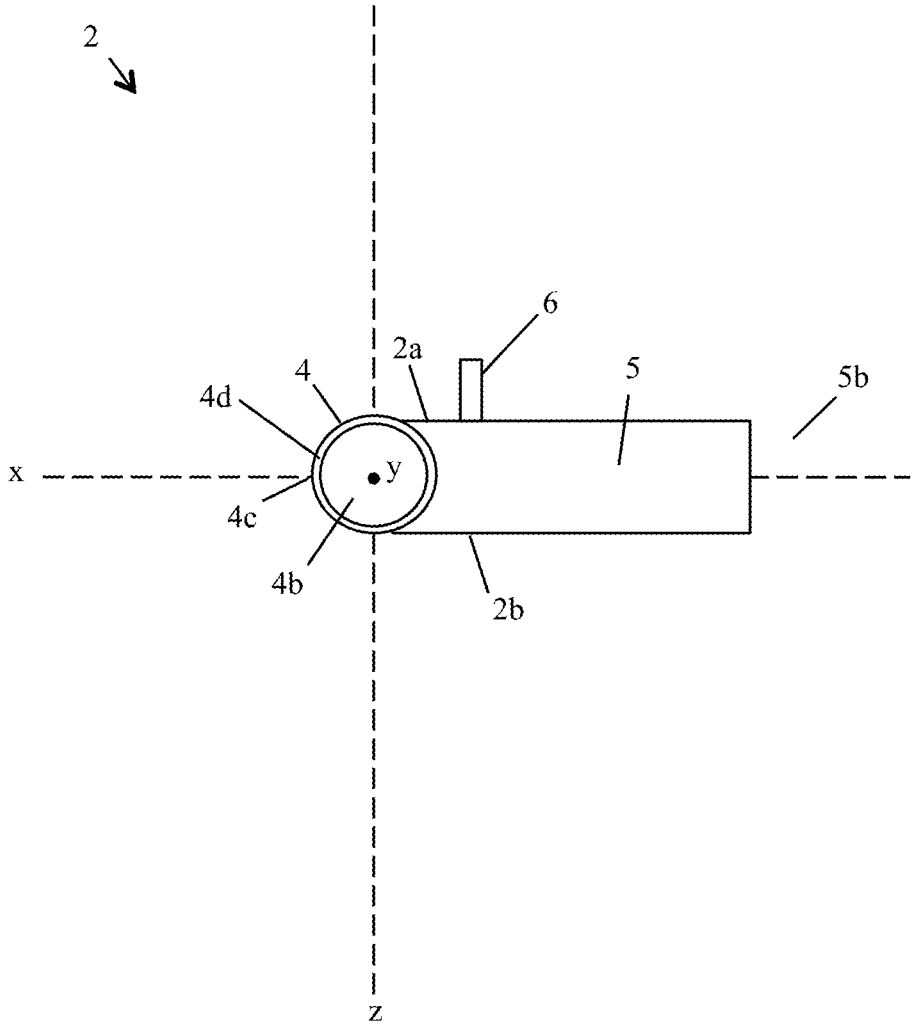
FIG. 3 is a left side view of an example configuration according to various embodiments.

FIG. 3 is a left side view of the putter head 2 according to various embodiments.

Referring to FIGS. 2 and 3, the putter head 2 comprises a front body portion 4 and a rear body portion 5. The front body portion 4 includes ends 4*a*, 4*b* and an axis y that runs longitudinally down the length of the front body portion 4 through the center of the ends 4*a*, 4*b*. A rounded, front surface 4*c* of the front body portion 4 serves as a striking face for contacting a golf ball. The rounded clubface of putter 2 advantageously prevents the ball from skidding or bouncing when struck.

The rear body portion 5 includes ends 5*a*, 5*b* and an axis x that runs longitudinally down the length of the rear body portion 5 through the center of the ends 5*a*, 5*b*, where the axes x and y are perpendicular. The end 5*a* of the rear body portion 5 is attached to the front body portion 4, such as by welding. Particularly, the rear body portion 5 is attached at a midway point that bisects the length (in the direction of the axis y) of the front body portion 4, such that the front body portion 4 and the rear body portion 5 form a T-shape.

The front body portion 4 comprises a wall 4*d* that forms a hollow cylindrical tube. In a preferred embodiment, the wall 4*d* has a thickness of 0.0625 inches and the hollow cylindrical tube has an outer diameter of 1.5 inches. Furthermore, the front body portion 4 and the rear body portion 5 may preferably be constructed of hot rolled steel, cold rolled steel, or stainless steel.

The putter head 2 further comprises a stem 6 formed on the rear body portion 5 and extending along axis z, where axis z is orthogonal to axes x and y. The shaft 3 may be attached to the putter head 2 at the stem 6. In some embodiments, the stem 6 may include threads to screw the putter head 2 into the shaft 3. Furthermore, in some embodiments, the stem may have an exterior diameter of 0.3125 inches and a height of 1.375 inches. The stem 6 is formed on the rear body portion 5 along the top side 2*a* of the putter head 2, preferably about 1.5 inches to 1.625 inches from the front surface 4*c* in the direction of the axis x.

In some embodiments, the putter head 2 further comprises at least one alignment line 8 formed on the top side 2*a* of the putter head 2. The alignment line(s) 8 is an aiming sight that allows a golfer to visually determine the approximate direction a ball will travel when impacted by the putter 2. For example, an alignment line 8 may be formed on an upper surface of the rear body portion 5 parallel to the axis x. Additionally or alternatively, an alignment line 8 may be formed on an upper surface of the front body portion 2 that is parallel to the axis y. Preferably, the alignment line(s) 8 are 0.25 inches wide and are formed by etching, painting, or the like.

FIGS. 4A-D are rear views of the putter head 2 according to various embodiments.

Figure 4A:
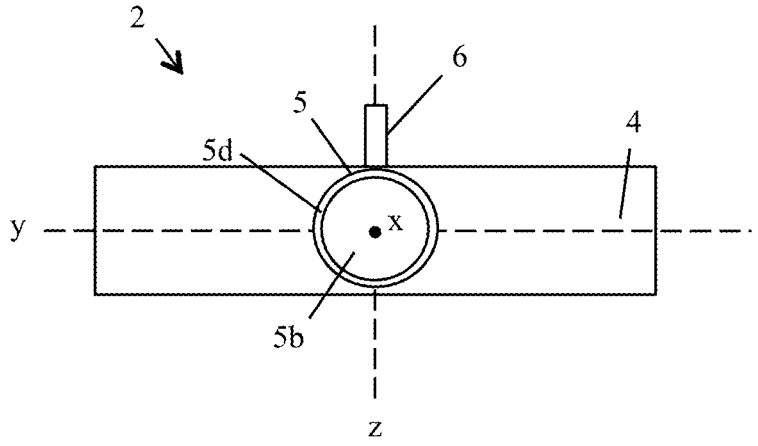
FIGS. 4A-D are rear views of example configurations according to various embodiments.
Figure 4B:
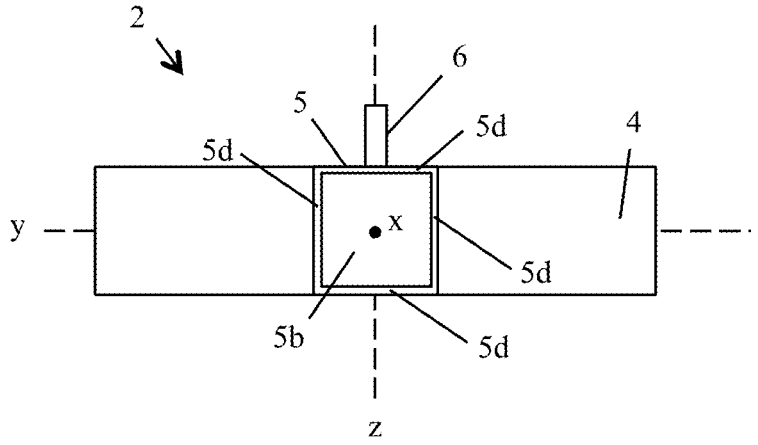
Figure 4C:
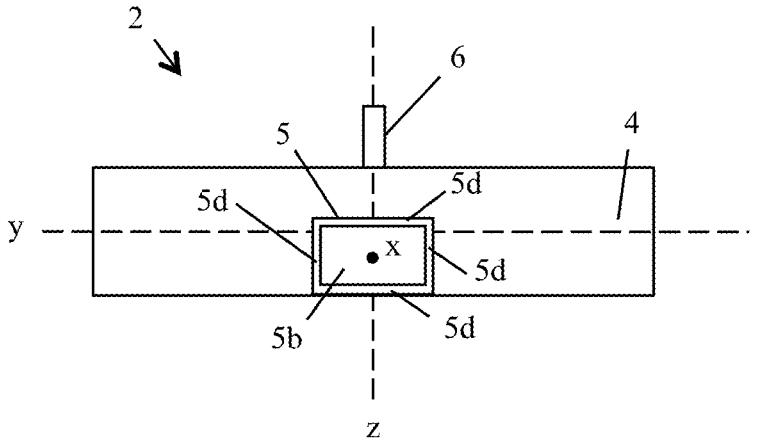
Figure 4D:
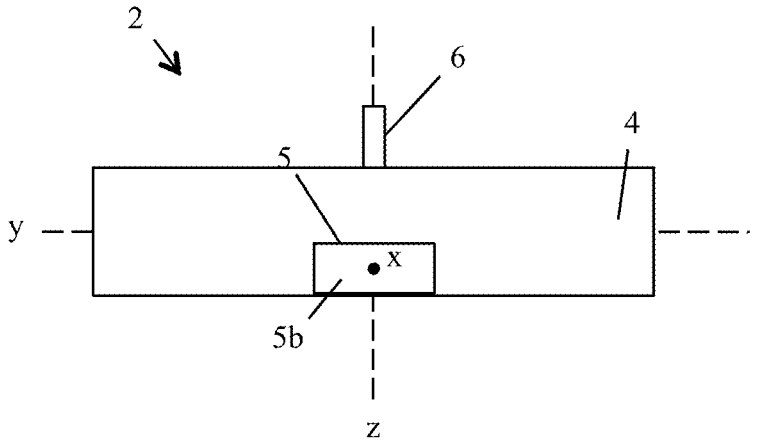

Referring to FIGS. 4A-D, the rear body portion 5 may take various shapes such as, but not limited to, a rectangular cuboid (i.e., each pair of adjacent faces meets in a right angle) or a circular cylinder. It shall be understood by a person of ordinary skill in the art that the terms rectangular cuboid and rectangular tube as used herein may also refer to square cuboid and square tube in certain circumstances apparent to those of ordinary skill. In some embodiments, the rear body portion 5 may be hollow. For example, FIG. 4A shows the rear body portion 5 comprising a wall 5*d* forming a hollow cylindrical tube, FIG. 4B shows the rear body portion 5 comprising four walls 5*d* forming a hollow square tube, and FIG. 4C shows the rear body portion 5 comprising four walls 5*d* forming a hollow rectangular tube. Preferably, the wall(s) 5*d* has a thickness of 0.0625 inches. In other embodiments, the rear body portion 5 may be solid. For example, FIG. 4D shows the rear body portion 5 may form a solid rectangular cuboid.

Figure 5A:
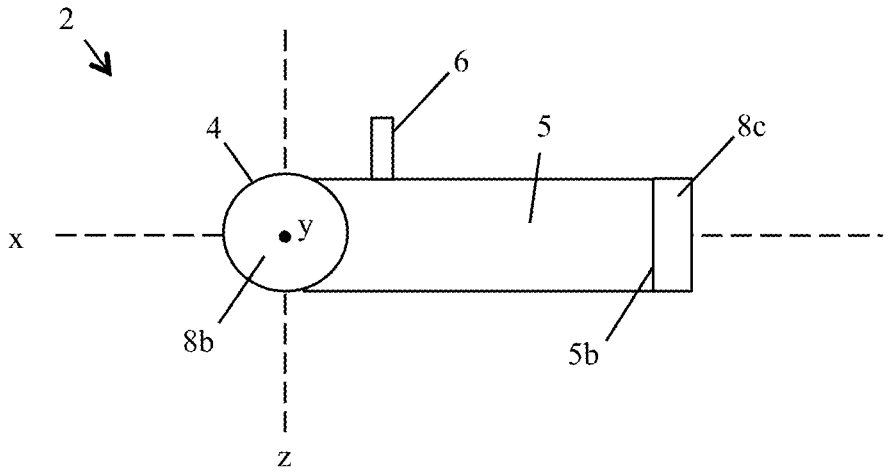
FIG. 5A is a left side view of an example configuration according to various embodiments.
Figure 5B:
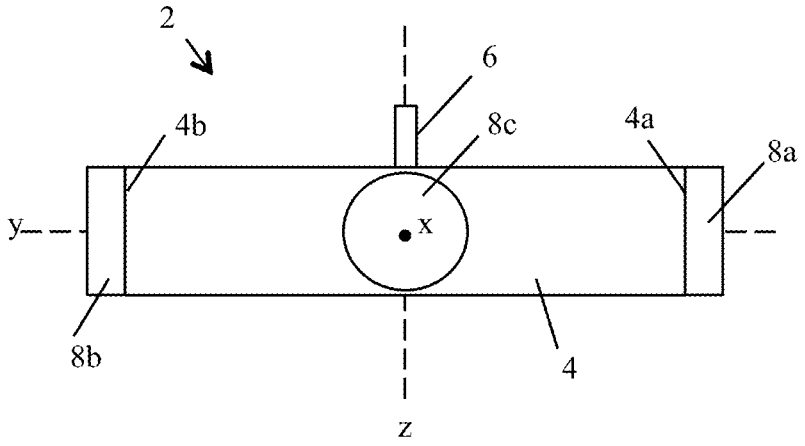
FIG. 5B is a rear view of an example configuration according to various embodiments.

FIG. 5A is a side view of the putter head 2 according to various embodiments, and FIG. 5B is a rear view of the putter head 2 according to various embodiments.

Referring to FIGS. 5A-B, the putter head 2 further comprises weights 7*a*, 7*b*, 7*c* that are attached to the distal ends of the T-shaped putter head 2. In other words, the first weight 7*a* is attached to the end 4*a* of the front body portion 4, the second weight 7*b* is attached to the end 4*b* of the front body portion 4, and the third weight 7*c* is attached to the end 5*b* of the rear body portion 5. In an exemplary embodiment, the weights 7*a*, 7*b*, 7*c* are attached to respective ends 4*a*, 4*b*, 5*b* by welding. Alternatively, the weights 7*a*, 7*b*, 7*c* may be attached using other suitable means.

The weights 7*a*, 7*b*, 7*c* are shaped similarly to the body portions to which they are attached. For example, like front body portion 4, the weights 7*a*, 7*b* are cylindrical in shape. Similarly, the weight 7*c* is cylindrical in shape if the rear body portion 5 is cylindrical, or the weight 7*c* is square cuboid if the rear body portion 5 is square tubular, etc. The weights 7*a*, 7*b*, 7*c* have a similar lateral cross-section as the front body portion 4 or the rear body portion 5 to cover the ends 4*a*, 4*b*, 5*b*, respectively.

In some embodiments, the weights 7*a*, 7*b*, 7*c* have a thickness of 0.0625 inches to 0.5 inches protruding from the ends 4*a*, 4*b* in the direction of the axis y or from the end 5*b* in the direction of the axis x. For example, another possible thickness may be 0.125 inches or 0.25 inches. The weights 7*a*, 7*b*, have the same thickness, and the weight 7*c* may have the same thickness as the weights 7*a*, 7*b* or may have a different thickness as the weights 7*a*, 7*b*.

Furthermore, in some embodiments, the length of the front body portion 4 along the axis y from end 4*a* to end 4*b* varies from 5.9375 inches to 6.875 inches. Similarly, in some embodiments, the length of the rear body portion 5 along the axis x from end 5*a* to end 5*b* varies from 3.25 inches to 3.5 inches. However, the front body portion 4 along the axis y and the rear body portion 5 along the axis x may be other suitable lengths as appropriate.

In some embodiments, the width of the rear body portion 5 in a direction parallel to axis y may be 1 inch to 1.75 inches, and the height of the rear body portion 5 in a direction parallel to axis z may be 0.125 inches to 1.5 inches. For example, Table 1 lists non-limiting examples of shapes and corresponding dimensions that the rear body portion 5 may form. It shall be understood that references to the width of the rear body portion 5 refers to an external width of the rear body portion 5 in a direction parallel to the axis y, and that references to the height of the rear body portion 5 refers to an external height of the rear body portion 5 in a direction parallel to the axis z. It shall also be understood that references to width and/or height of a circular tube refers to its external diameter in a direction a direction parallel to the axis y or the axis Z.

TABLE 1

| Shape | Width | Height |
|---|---|---|
| Circular tube | 1.5 inches | 1.5 inches |
| Square tube | 1.5 inches | 1.5 inches |
| Square tube | 1.25 inches | 1.25 inches |
| Square tube | 1 inch | 1 inch |
| Rectangular tube | 1.75 inches | 1.5 inches |
| Solid rectangular cuboid | 1.5 inches | 0.125 inches |

Accordingly, the total length of the putter head 2 along the axis y may be 6.5 inches to 7 inches. The length of the putter head 2 includes the weights 7*a*, 7*b*, and the front body portion 4 along the axis y. Similarly, the total width of the putter head 2 along the axis x may be 4.25 inches to 5.25 inches. The width of the putter head 2 includes the front body portion 4, the rear body portion 5, and the weight 7*c* along the axis x.

The particular shape, dimensions, and weight distribution of the putter head 2 allow the putter 1 to be freestanding. In other words, a golfer may set the bottom side 2*b* of the putter head 2 on the ground and let go of the putter 2, and the putter 1 will remain standing and not fall over. This is advantageous to allow a golfer to set the putter 1 adjacent to a golf ball, walk behind the ball and putter 1 to determine an appropriate target or trajectory, return to the putter 1 to make aiming adjustments to the putter 1 as it stands adjacent to the ball, and repeat if necessary. More importantly, after the golfer has completed aiming and returns to the ball to attempt the putt, the putter 2 is already aimed toward the appropriate target to strike the ball in the hole, and the golfer does not have to take aim based on a different viewing angle than from directly behind the ball as in the related art.

Figure 6:
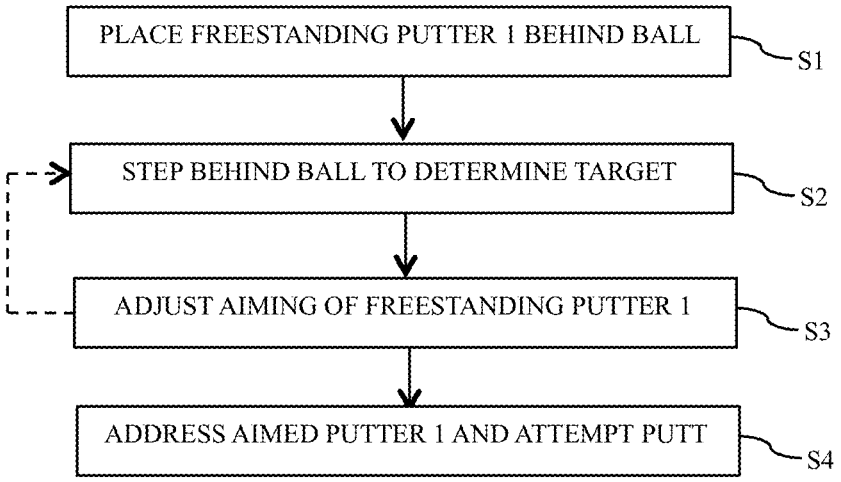
FIG. 6 is a flowchart of an exemplary method of using an example configuration according to various embodiments.

FIG. 6 is a flowchart of an exemplary method of using the putter 1 according to various embodiments.

Referring to FIG. 6, the method begins with the golfer placing the putter 1 behind the golf ball such that the putter 1 is freestanding (step S1). Next, the golfer may step away from the ball and the putter 1 to determine an appropriate target or trajectory in order to successfully strike the ball into the hole (step S2). The golfer may then return to the putter and make any adjustments to the direction to which the putter 1 is aiming (step S3). For example, the golfer may slightly rotate putter 1 such that the striking face of the front surface 2*d* is aiming slightly more to the left or right. The golfer may repeat steps S2 and S3 as necessary to properly aim the putter 1.

Once the golfer has determined that the freestanding putter 1 is properly aimed, the golfer may return to the side of the golf ball and putter 1 at address and attempt a putt (step S4). Since the putter 1 is already properly aimed at an appropriate target or trajectory, the golfer advantageously does not have to again take aim at address based on a different viewing angle than from directly behind the ball.

Various embodiments have been described with reference to the accompanying drawings. As is apparent from the foregoing description, the various embodiments address the need in the art for a golf putter that enables a golfer to aim and subsequently strike a golf ball with greater accuracy and consistency. Particularly, the freestanding putter 1 includes a rounded clubface to prevent a golf ball from skidding or bouncing when struck therewith. Furthermore, the freestanding nature of the putter 1 enables a golfer to repeatedly step away from the putter 1 for a view of the ball to the cup and return to the putter 1 to adjust the direction in which the putter 1 is aiming. Moreover, once the golfer is ready to attempt a putt, he or she can address the putter 1 and ball without losing the previously established aim of the putter 1.

Additionally, although the disclosed subject matter has been described in conjunction with specific embodiments, numerous modifications and alterations are well within the scope of the present disclosure. Accordingly, the specification and drawings are to be regarded in an illustrative rather than a restrictive sense.

The invention claimed is:

1. A freestanding golf putter comprising:

a T-shaped putter head comprising:

a front body portion comprising a first hollow cylindrical tube comprising a first end, a second end, and an axis that extends in a first direction through a center of the first end and a center of the second end; and a rear body portion comprising a third end, a fourth end, and an axis that extends in a second direction through a center of the third end and a center of the fourth end;

wherein the first direction is perpendicular to the second direction, wherein the third end of the rear body portion is attached to the front body portion at a point that bisects length of the front body portion from the first end to the second end in the first direction, wherein length of the rear body portion in the second direction is greater than width of the rear body portion in the first direction, and wherein a rounded surface along the length of the front body portion from the first end to the second end in the first direction forms a striking face for contacting a golf ball; and a shaft attached to the putter head.

2. The freestanding golf putter according to claim 1, wherein the putter head further comprises:

a first weight attached to the first end of the front body portion;

a second weight attached to the second end of the front body portion; and a third weight attached to the fourth end of the rear body portion.

3. The freestanding golf putter according to claim 2, wherein thickness of each of the first weight, the second weight, and the third weight is 0.125 inches to 0.5 inches.

4. The freestanding putter according to claim 2, wherein:

length of the putter head in the first direction is 6.5 inches to 7 inches; and width of the putter head in the second direction is 4.25 inches to 5.25 inches.

5. The freestanding putter according to claim 1, wherein outer diameter of the front body portion is 1.5 inches.

6. The freestanding putter according to claim 1, wherein the front body portion comprises a wall having thickness of 0.0625 inches forming the first hollow cylindrical tube.

7. The freestanding golf putter according to claim 1, wherein the rear body portion further comprises one of a second hollow cylindrical tube and a hollow rectangular tube.

8. The freestanding golf putter according to claim 7, wherein the rear body portion further comprises at least one wall having thickness of 0.0625 inches forming the one of the second hollow cylindrical tube and the hollow rectangular tube.

9. The freestanding golf putter according to claim 1, wherein the rear body portion comprises a solid cuboid member.

10. The freestanding golf putter according to claim 1, wherein:

width of the rear body portion in the first direction is 1 inch to 1.75 inches; and height of the rear body portion in a third direction orthogonal to the first direction and the second direction is 0.125 inches to 1.5 inches.

11. The freestanding golf putter according to claim 1, wherein length of the rear body portion from the third end to the fourth end in the second direction is 3.25 to 3.75.

12. The freestanding golf putter according to claim 11, wherein the putter head further comprises at least one alignment line formed on an upper surface of the rear body portion and parallel to the first direction.

13. The freestanding golf putter according to claim 1, wherein the putter head further comprises at least one alignment line formed on an upper surface of the rear body portion and parallel to the second direction.

14. The freestanding golf putter according to claim 1, wherein the putter further comprises a stem attached to the rear body portion and extending in a third direction orthogonal to the first direction and the second direction, wherein the shaft is attached to the stem.

15. The freestanding golf putter according to claim 1, wherein the front body portion and the rear body portion are formed of steel or stainless steel.

* * * * *